United States Patent [19]

Messinger

[11] Patent Number: 4,991,295

[45] Date of Patent: Feb. 12, 1991

[54] SHAVING HEAD FOR DRY SHAVING APPARATUS

[75] Inventor: Werner Messinger, Kronberg, Fed. Rep. of Germany

[73] Assignee: Braun Aktiengesellschaft, Frankfurt, Fed. Rep. of Germany

[21] Appl. No.: 410,363

[22] Filed: Sep. 20, 1989

[30] Foreign Application Priority Data

Sep. 30, 1988 [DE] Fed. Rep. of Germany ..... 3833179

[51] Int. Cl.[5] ..... B26B 19/06

[52] U.S. Cl. ..... 30/43.92; 30/346.51

[58] Field of Search ..... 30/43.92, 43.91, 43.9, 30/43.8, 346.51

[56] References Cited

U.S. PATENT DOCUMENTS 4,271,590 6/1981 Ernst ..... 30/43.92

4,707,916 11/1987 Kness et al. ..... 30/43.92

FOREIGN PATENT DOCUMENTS 49702 1/1974 Japan .

467136 2/1969 Switzerland .

*Primary Examiner*—Douglas D. Watts

*Attorney, Agent, or Firm*—Fish & Richardson

[57] ABSTRACT

The invention is directed to a shaving head for dry shaving apparatus, comprising a shaving head frame arranged on the shaver housing so as to be removable therefrom and a circumferentially closed, box-shaped exchangeable frame of a material of limited elasticity which is insertable into the shaving head frame, the exchangeable frame having a shaving foil mounted therein in arched form which is in cooperative relation with a reciprocating lower cutter assembly of suitable configuration which is urged against the foil by spring means, with corresponding holding and guiding means being provided on the exchangeable frame as well as on the shaving head frame to guide the exchangeable from in the shaving head frame in vertical direction.

7 Claims, 2 Drawing Sheets

SHAVING HEAD FOR DRY SHAVING APPARATUS

This invention relates to a shaving head for dry shaving apparatus.

BACKGROUND OF THE INVENTION

Shaving heads constructed in this manner and known, for example, from U.S. Pat. No. 4,271,590 have the advantage that for cleaning purposes and for the replacement of damaged or worn down shaving foils they can be easily disassembled and refitted, also by laymen and inexperienced users, without exposing the delicate shaving foil to the risk of damage. The manufacture of the exchangeable frame and the mounting of the shaving foil thereon can be accomplished in an injection-molding process, thus eliminating the need for additional operation cycles.

To enable the shaving foil to yield under shaving pressure in cooperation with the lower cutter also when it is mounted in an exchangeable frame, so that relative contact between foil and cutter is maintained and damage to the shaving foil due to buckling and flexing is avoided, a variety of attempts have been made which, however, have been unsatisfactory so far and, as a result, were not adopted in series production, in contrast to the yielding mounting of the shaving foil in the shaving head frame directly.

Accordingly, the arrangement of torsion springs as an integral part of the exchangeable frame appears at first advantageous because it, too, dispenses with the need for an additional operation, however, it has been established that this type of spring suspension can only be implemented with relatively stiff springs because of the necessary thickness of the material, and that the damping of vibrations incited by the working motion of the lower cutter is insufficient (U.S. Pat. No. 4,271,590, Japanese Utility Pat. Application No. 49-2702). In addition, the exchangeable frame disclosed in the last-mentioned reference cannot be removed from the shaving head frame by simple means.

On the basis of this state of the art, it is an object of the present invention to ensure in a shaving head of the type initially referred to that the shaving foil is in a position to readily follow the yielding motion of the lower cutter under shaving pressure, while remaining locked against entrainment by the working motion of the lower cutter, and to ensure ready removal of the shaving foil together with the exchangeable frame at any time.

SUMMARY OF THE INVENTION

This requirement is satisfied in a surprisingly simple manner. The mounting and guiding of the exchangeable frame in the shaving head frame as disclosed in the invention can be implemented in a variety of ways. The arrangement and configuration of the tongues permit it to vary the elasticity of the longitudinal sides of the frame relative to the tongues in accordance with their separate functions by suitable selection of the material thickness and to adjust a desired friction between the surfaces of the tongues and the sides of the shaving head frame by suitable selection of the contact pressure and the coefficient of friction, whereby vibrations can be dampened. Further advantageous and appropriate special features for further embodiments of the invention will become apparent from the following description of particular embodiments.

BRIEF DESCRIPTION OF THE DRAWINGS

Embodiments of the invention are illustrated in the drawings, in which.

DESCRIPTION OF PARTICULAR EMBODIMENTS

Figure 1:
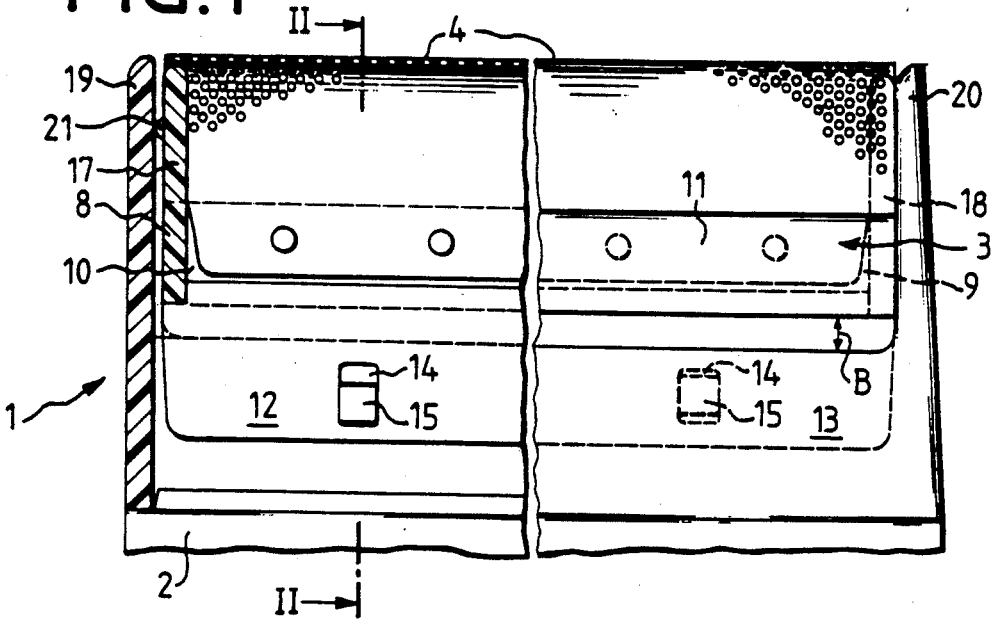
FIG. 1 is a view of the shaving head, partly in longitudinal section taken on the line I—I of FIG. 2——left-hand half——, and partly in fragmentary view——-right-hand half.

The shaving head for dry shaving apparatus as shown in FIG. 1 is substantially comprised of a shaving head frame 1 of conventional structure which is seated on the shaver housing 2 so as to be removable therefrom. Adapted to be inserted into the shaving head frame 1 is a circumferentially closed, box-shaped exchangeable frame 3 which is made of a material of limited elasticity and has a shaving foil 4 mounted therein in arched form. The shaving foil 4 is in cooperative relation with a lower cutter 5 ground to conform to the curvature of the arched foil, the cutter being urged into engagement with the curvature of the shaving foil 4 by a spring 6 and being caused to reciprocate by an oscillating lever 7 driven by a motor not shown.

Figure 3:
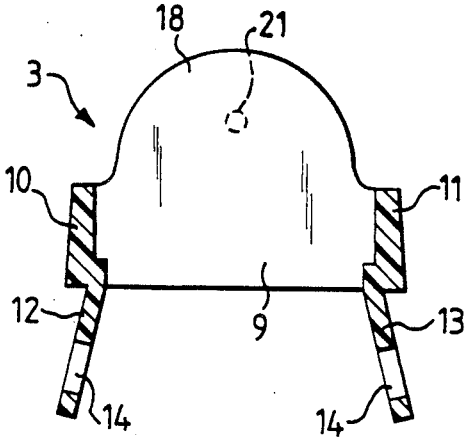
FIG. 3 is a view of the exchangeable frame taken in section on the line II—II of FIG. 1.

The exchangeable frame 3 shown in FIG. 3 in section in withdrawn condition and with the shaving foil removed has two lateral sides 8 and 9 and two longitudinal sides 10 and 11 having respective tongues 12 and 13 integrally formed on their lower edges in a slightly inwardly recessed manner. The tongues are elastic, extending at a slight outward angle in the position of rest shown in FIG. 3.

Provided on the tongues 12 and 13 is the one part of the mounting and guiding means for the exchangeable frame 3 in the shaving head frame 1 in the form of openings 14 which are engaged by the other part of the mounting and guiding means comprising hook-shaped projections 15 which are provided on the associated inner surfaces 16 of the shaving head frame 1. The fits between the openings and the projections are partly close sliding fits allowing only a vertical movement but no appreciable movement in the working direction of the lower cutter, whereas for the yielding motion of exchangeable frame and shaving foil in, or in opposition to, the direction of arrow A a clearance fit corresponding to this amount of travel is provided, as shown in FIG. 1.

It is to be understood that the mounting and guiding means may be interchanged, so that the projections 15.1 are provided on the tongues 12, 13 while the openings 14.1 are provided on the inner surfaces 16 of the shaving head frame 1. The height of the openings 14 and 14.1 is slightly larger than the possible amount of travel of the lower cutter 5 under shaving pressure, that is, in opposition to the direction of arrow A and the selected amount of displacement B of the exchangeable frame 3 relative to the shaving head frame 1, which displacement is limited in downward direction by the seating engagment of the lower edge of the exchangeable frame with the upper edge of the shaving head frame. Extending upwardly from the lateral sides 8, 9 of the exchangeable frame 3 are end walls 17, 18 having sliding knobs 21 on their outer surfaces proximate the end walls 19, 20 of the shaving head frame 1. The relative distance of the end walls 17, 18 of the exchangeable frame has some positive allowance with respect to the corresponding relative distance of the end walls 19, 20 of the shaving head frame 1, causing the respective end wall pairs 17, 19 and 18, 20 to rest against each other through the sliding knobs 21 at a slight tension.

Figure 2:
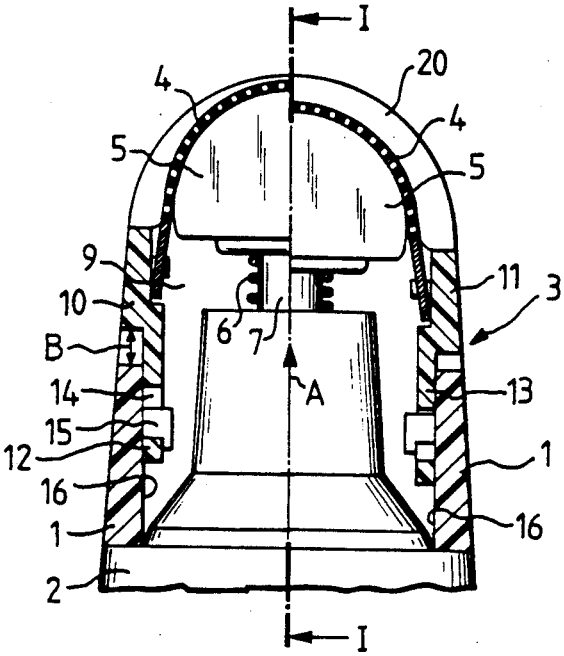
FIG. 2 is a view of the shaving head taken in section on the line II—II of FIG. 1, illustrating two conditions of motion of the exchangeable frame and the lower cutter.

Finally, the shaving foil 4 is secured to the longitudinal sides 10 and 11 of the exchangeable frame, the securing in this embodiment being rigid as a rule which is accomplished, for example, by welding together or injection molding therearound. Of course, it is also possible to provide an additional elastically yielding mounting for the shaving foil 4 in a manner known in the art (for example, as disclosed in German Pat. No. 1,168,796), as indicated by reference numeral 22 on the right-hand side of FIG. 4. In the use of an exchangeable frame 3.1 having a twin-arched shaving foil 4.1, it will be an advantage to provide an additional vertical guiding means in the area of the abutting end walls 23, 24 referred to above which are, however, wider in this embodiment, the guiding means being in the form of a bolt 25 provided on the end wall 24 of the shaving head frame 1.1 and engaging into a vertical groove 26 in the end wall 23 of the exchangeable frame 3.1 (FIG. 5). In this embodiment, too, the arrangement of the guiding means provided on the exchangeable frame and on the shaving head frame may be as illustrated in FIG. 2.

Figure 4:
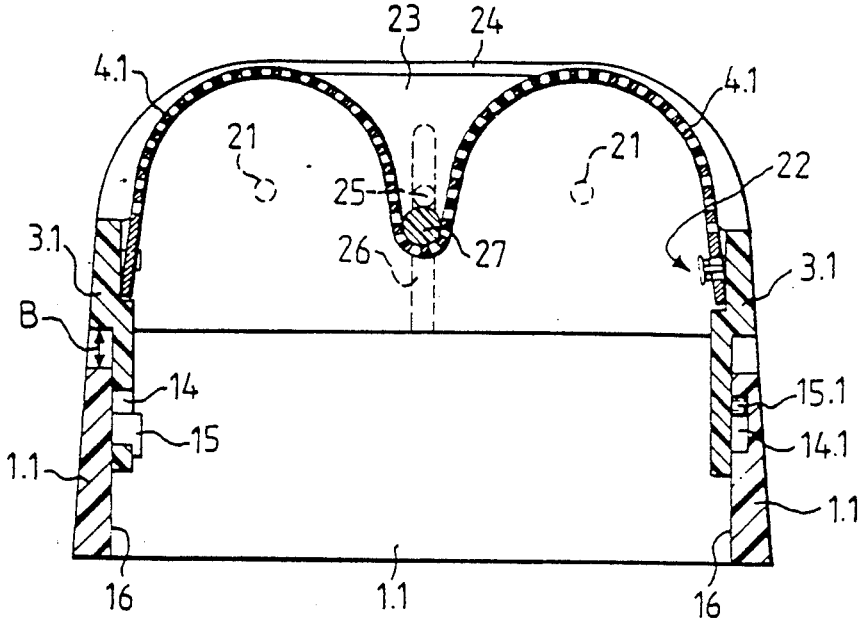
FIG. 4 is a corresponding view in section of a shaving head having a twin-arched shaving foil mounted therein and showing some details in modified form.
Figure 5:
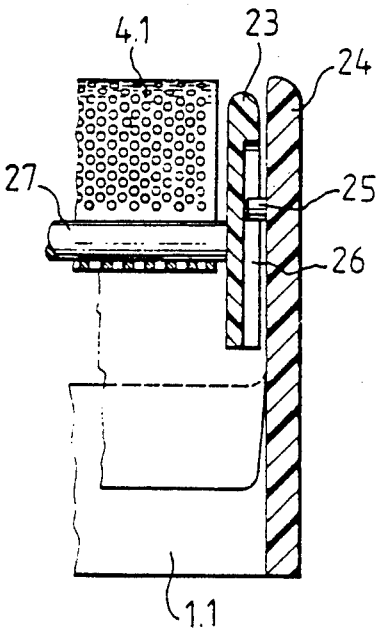
FIG. 5 is a fragmentary view thereof, in longitudinal section.

The shaving foil 4.1 of FIGS. 4 and 5 is supported in the trough between the two arches by a bar 27 or the like which in turn is held on the two end walls 23 of the exchangeable frame 3.1. The further configuration of the holding and guiding means and the associated parts of the two frames 1.1 and 3.1 corresponds to the shaving head arrangement shown in FIGS. 1 and 2 in which the shaving foil has a single arch.

Figure 6:
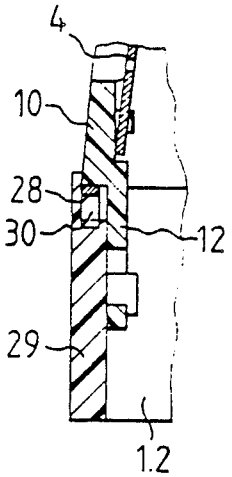
FIG. 6 is a further fragmentary view of a detail.

If it is intended to provide a weaker configuration of the spring 6 for the lower cutter assembly 5, it may be advantageous to provide further spring means, for example, leaf springs 28, in the area of motion between the exchangeable frame 3 and the shaving head frame 1, which spring means act directly intermediate the two parts. As FIG. 6 shows, it will be suitable in this embodiment to provide one groove 30 each on the upper edge of the longitudinal walls 29 of the shaving head frame 1.2, in which groove the leaf spring 28 is seated, bearing against the lower edge of the associated longitudinal wall 10 of the exchangeable frame 3.

For assembly of the shaving head, the exchangeable frame 3 or 3.1 is inwardly deformed by the action of pressure on its longitudinal sides 10, 11, to such an extent that its tongues 12, 13 can be introduced into the shaving head frame 1, 1.1, 1.2 from above, until the holding means are in relative locking engagement. In the process, the tongues 12, 13 rearwardly engage the associated inner surfaces 16 of the shaving head frame against which they rest at a slight tension.

In this manner, the exchangeable frame, in conjunction with the single- or multiple-arched shaving foil mounted therein and the lower cutter assembly cooperating therewith, are in a position to yield to the shaving pressure in the direction of the interior of the housing, without causing buckling of the shaving foil and a reduction in the contact area between the two cutting parts. In this arrangement, the corresponding surfaces of the exchangeable frame resting against the walls of the shaving head frame at a slight tension ensure that the displacement movement occurs under a certain friction which largely eliminates the occurrence of wobble and vibrations of the exchangeable frame. The additional constructional expenditure involved is low, so that economy of production is also ensured.

I claim:

1. A shaving head for dry shaving apparatus that includes a shaver housing, a reciprocating lower cutter assembly of suitable configuration, and spring means for urging said lower cutter assembly against a foil, comprising a shaving head frame arranged on said shaver housing so as to be removable therefrom, a circumferentially closed, box-shaped exchangeable frame of resilient material which is insertable into said shaving head frame, a shaving foil mounted in arched form on said exchangeable frame for cooperative relation with said reciprocating lower cutter assembly which is urged against the foil by said spring means, means on at least two sides of said exchangeable frame for holding said exchangeable frame movably within limits in said shaving head frame and for guiding said exchangeable frame substantially vertically in the direction of action (arrow A) of said spring means, and cooperating holding and guiding means on associated surfaces of said shaving head frame.

2. The shaving head as claimed in claim 1 wherein said exchangeable frame includes elastic tongues formed on the undersides of longitudinal sides of said exchangeable frame, said tongues extending at a slight outward angle in the withdrawn condition of said exchangeable frame and having thereon one part of said holding and guiding means.

3. The shaving head as claimed in claim 1 wherein said holding and guiding means are configured as openings and as suitably dimensioned projections engaging in said openings.

4. The shaving head as claimed in claim 1 and further including means for holding said shaving foil movably within limits in said exchangeable frame in the direction of action (arrow A) of said spring means.

5. A shaving head for dry shaving apparatus that includes a shaver housing, a reciprocating lower cutter assembly of suitable configuration, and spring means for urging said lower cutter assembly against a foil, comprising a shaving head frame arranged on said shaver housing so as to be removable therefrom, said shaving head frame having end walls, a circumferentially closed, box-shaped exchangeable frame of resilient material of limited elasticity which is insertable into said shaving head frame, a shaving foil mounted in arch form on said exchangeable frame for cooperative relation with said reciprocating lower cutter assembly which is urged against the foil by said spring means, said exchangeable frame in the area of the shaving foil arch having end walls extending upwardly from lateral sides of said exchangeable frame, sliding knobs on outer surfaces of said end walls, the dimension of said exchangeable frame being selected such that said end walls rest against said end walls of said shaving head frame at a slight tension, means on at least two sides of said exchangeable frame for holding said exchangeable frame movably within limits in said shaving head frame and for guiding said exchangeable frame substantially vertically in the direction of action (arrow A) of said spring means, and cooperating holding and guiding means on associated surfaces of said shaving head frame.

6. A shaving head for dry shaving apparatus that includes a shaver housing, a reciprocating lower cutter assembly of suitable configuration, and spring means for urging said lower cutter assembly against a foil, comprising a shaving head frame arranged on said shaver housing so as to be removable therefrom, a circumferentially closed, box-shaped exchangeable frame of resilient material of limited elasticity which is insertable into said shaving head frame, a shaving foil mounted in arched form on said exchangeable frame for cooperative relation with said reciprocating lower cutter assembly which is urged against the foil by said spring means, means on at least two sides of said exchangeable frame for holding said exchangeable frame movably within limits in said shaving head frame and for guiding said exchangeable frame substantially vertically in the direction of action (arrow A) of said spring means, cooperating holding and guiding means on associated surfaces of said shaving head frame, and further spring means which act directly intermediate said shaving head frame and said exchangeable frame.

7. A shaving head for dry shaving apparatus that includes a shaver housing, a reciprocating lower cutter assembly of suitable configuration, and spring means for urging said lower cutter assembly against a foil, comprising a shaving head frame arranged on said shaver housing so as to be removable therefrom, said shaving head frame having end walls, a circumferentially closed, box-shaped exchangeable frame of resilient material of limited elasticity which is insertable into said shaving head frame, a double-arched shaving foil mounted on said exchangeable frame for cooperative relation with said reciprocating lower cutter assembly which is urged against the foil by said spring means, said exchangeable frame having end walls, means on at last two sides of said exchangeable frame for holding said exchangeable frame movably within limits in said shaving head frame and for guiding said exchangeable frame substantially vertically in the direction of action (arrow A) of said spring means, cooperating holding and guiding means on associated surfaces of said shaving head frame, and means between said end walls of said exchangeable frame and said shaving head frame for movably guiding said exchangeable frame within limits in the vertical direction.

* * * * *